US010001325B2

(12) United States Patent
Bergh

(10) Patent No.: US 10,001,325 B2
(45) Date of Patent: Jun. 19, 2018

(54) FORMED MICROCHANNEL HEAT EXCHANGER WITH MULTIPLE LAYERS

(75) Inventor: Charles J. Bergh, Berwyn, PA (US)

(73) Assignee: Ingersoll-Rand Company, Davidson, NC (US)

( * ) Notice: Subject to any disclaimer, the term of this patent is extended or adjusted under 35 U.S.C. 154(b) by 598 days.

(21) Appl. No.: 13/638,627

(22) PCT Filed: Apr. 9, 2010

(86) PCT No.: PCT/US2010/030462
§ 371 (c)(1),
(2), (4) Date: Oct. 1, 2012

(87) PCT Pub. No.: WO2011/126488
PCT Pub. Date: Oct. 13, 2011

(65) Prior Publication Data
US 2013/0020061 A1 Jan. 24, 2013

(51) Int. Cl.
*F28F 3/00* (2006.01)
*F28D 9/00* (2006.01)
(Continued)

(52) U.S. Cl.
CPC ..... *F28D 9/0031* (2013.01); *F28D 1/0316* (2013.01); *F28F 3/025* (2013.01);
(Continued)

(58) Field of Classification Search
CPC .... F28D 1/0316; F28D 1/0341; F28D 1/0333; F28D 1/05391; F28D 9/0031;
(Continued)

(56) References Cited

U.S. PATENT DOCUMENTS 1,851,881 A * 3/1932 Watt ..... 165/169
3,205,938 A * 9/1965 Robinson ..... F28D 1/0316 165/108
(Continued)

FOREIGN PATENT DOCUMENTS

DE 2320800 1/1974
EP 2523743 7/2012
(Continued)

OTHER PUBLICATIONS

WO 0107854 A1 machine translation.*
(Continued)

*Primary Examiner* — Len Tran
*Assistant Examiner* — Gordon Jones
(74) *Attorney, Agent, or Firm* — Taft Stettinius & Hollister LLP

(57) ABSTRACT

A heat exchanger (80) includes a plurality of heat exchange layers (95) stacked in a stackwise direction. Each of the layers includes a first plate (110) and a second plate (115), each of the first plate and the second plate includes a portion of a first enclosed header (120), a second enclosed header (125) and at least one flow channel (130) that extends between the first enclosed header and the second enclosed header. The first plate and the second plate are fixedly attached to one another to completely define the first enclosed header, the second enclosed header, and the at least one flow channel. An inlet header (85) is in fluid communication with the first enclosed header of each of the plurality of heat exchange layers (95) to direct a flow of fluid to the heat exchange layers. An outlet header is in fluid communication with the second enclosed header of each of the plurality of heat exchange layers to direct the flow of fluid from the heat exchange layers. The heat exchanger also
(Continued)

includes a plurality of fins (100) with each positioned between adjacent heat exchange layers.

8 Claims, 9 Drawing Sheets

(51) Int. Cl.
*F28D 1/03* (2006.01)
*F28F 3/02* (2006.01)
*F28F 9/02* (2006.01)
*F28D 21/00* (2006.01)

(52) U.S. Cl.
CPC ..... *F28F 9/0263* (2013.01); *F28F 9/0273* (2013.01); *F28D 2021/0038* (2013.01); *F28F 2210/00* (2013.01); *F28F 2210/02* (2013.01); *F28F 2260/02* (2013.01)

(58) Field of Classification Search
CPC ..... F28F 9/0212; F28F 9/0224; F28F 9/0246; F28F 9/0256; F28F 9/0423; F28F 1/12; F28F 1/26; F28F 1/20; F28F 1/128; F28F 9/0031; F28F 2210/00; F28F 3/025; F28F 9/0273
See application file for complete search history.

(56) References Cited

U.S. PATENT DOCUMENTS 4,093,024 A 6/1978 Middleton
4,171,622 A * 10/1979 Yamaguchi ..... F25B 13/00 62/160
4,926,933 A * 5/1990 Gray ..... B29C 47/24 165/173
4,966,230 A 10/1990 Hughes et al.
5,318,114 A * 6/1994 Sasaki ..... F28D 1/035 165/109.1
6,161,616 A * 12/2000 Haussmann ..... B60H 1/3227 165/152
7,044,207 B1 5/2006 Guidat et al.
7,503,382 B2 * 3/2009 Maezawa ..... F25B 39/00 165/144
9,482,453 B2 * 11/2016 Bergh ..... F25B 29/003
2003/0051501 A1 * 3/2003 Matsushima ..... F25B 39/02 62/435
2004/0261986 A1 * 12/2004 Insalaco ..... F28F 1/022 165/181
2010/0012303 A1 * 1/2010 Domen ..... F28F 3/042 165/166
2011/0139422 A1 * 6/2011 Oddi et al. ..... 165/173
2011/0290465 A1 * 12/2011 Joshi et al. ..... 165/175
2014/0166256 A1 * 6/2014 Marciniak et al. ..... 165/173
2015/0144309 A1 * 5/2015 Nash ..... F28F 3/04 165/133
2016/0211192 A1 * 7/2016 Mizuno ..... H05K 7/20927

FOREIGN PATENT DOCUMENTS

GB 1277872 A * 6/1972 ..... F28D 1/0341
GB 1277872 A 6/1972
GB 2391296 A 2/2004
WO WO 0107854 A1 * 2/2001 ..... F28D 9/0006
WO 2008003151 A1 1/2008
WO 2008060270 A1 5/2008
WO 2009139998 A2 11/2009

OTHER PUBLICATIONS

International Search Report and Written Opinion for Application No. PCT/US2010/030462 dated Jun. 14, 2012 33 pages).
European Search Report; European Patent Office; European Patent Application No. 10715385; dated Feb. 12, 2015; 6 pages.
European Examination Report, EP10715385.0, Ingersoll-Rand Company; dated Oct. 30, 2015.

* cited by examiner

FORMED MICROCHANNEL HEAT EXCHANGER WITH MULTIPLE LAYERS

BACKGROUND

The present invention relates to heat exchangers, and more particularly to microchannel heat exchangers that are assembled using formed plates.

Microchannel heat exchangers include a plurality of small channels through which a first fluid flows. The large surface area to volume ratio improves heat transfer efficiency, thereby allowing for the use of smaller heat exchangers.

However, microchannel heat exchangers often include channels formed from extruded tubes that are brazed into the heat exchanger assembly. The number of tubes needed and the likelihood of a failed brazed joint increases the cost of microchannel heat exchangers.

SUMMARY

In one embodiment, the invention provides a heat exchanger that includes a plurality of heat exchange layers stacked in a stackwise direction. Each of the layers includes a first plate and a second plate, each of the first plate and the second plate includes a portion of a first enclosed header, a second enclosed header and at least one flow channel that extends between the first enclosed header and the second enclosed header. The first plate and the second plate are fixedly attached to one another to completely define the first enclosed header, the second enclosed header, and the flow channel. An inlet header is in fluid communication with the first enclosed header of each of the plurality of heat exchange layers to direct a flow of fluid to the heat exchange layers. An outlet header is in fluid communication with the second enclosed header of each of the plurality of heat exchange layers to direct the flow of fluid from the heat exchange layers. The heat exchanger also includes a plurality of fins with each positioned between adjacent heat exchange layers.

In another construction, the invention provides a heat exchanger that includes a plurality of heat exchange layers stacked in a stackwise direction. Each of the layers includes a first plate and a second plate, each of the first plate and the second plate includes a portion of a first enclosed header, a second enclosed header and at least one flow path that extends between the first enclosed header and the second enclosed header. The first plate and the second plate are fixedly attached to one another to completely define the first enclosed header, the second enclosed header, and the flow path. A flow device has a first end connected to the second enclosed header of a first of the plurality of heat exchange layers and a second end connected to the first enclosed header of a second of the plurality of heat exchange layers to connect the first of the plurality of heat exchange layers and the second of the plurality of heat exchange layers in series. An inlet header is in fluid communication with the first enclosed header of the first of the plurality of heat exchange layers to direct a flow of fluid to the first of the plurality of heat exchange layers. An outlet header is in fluid communication with the second enclosed header of the second of the plurality of heat exchange layers to direct the flow of fluid from the second of the plurality of heat exchange layers. A layer of fins is positioned between the first of the plurality of heat exchange layers and the second of the plurality of heat exchange layers.

In yet another construction, the invention provides a heat exchanger that includes a plurality of heat exchange layers arranged in a stackwise direction. Each of the heat exchange layers includes an inlet and an outlet. A plurality of fins are arranged such that at least one fin is positioned between adjacent heat exchange layers. An inlet header outer wall defines a central axis and an inner wall is disposed within the outer wall to define a first space therebetween. The outer wall is coupled to at least one of the plurality of heat exchange layers to provide fluid communication between the first space and the inlet. A filler plug is disposed within the inner wall to define a second space therebetween. The second space is in fluid communication with an inlet to receive a flow of fluid. The second space has a flow cross sectional area measured normal to the central axis, the flow cross sectional area varying along the length of the central axis.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
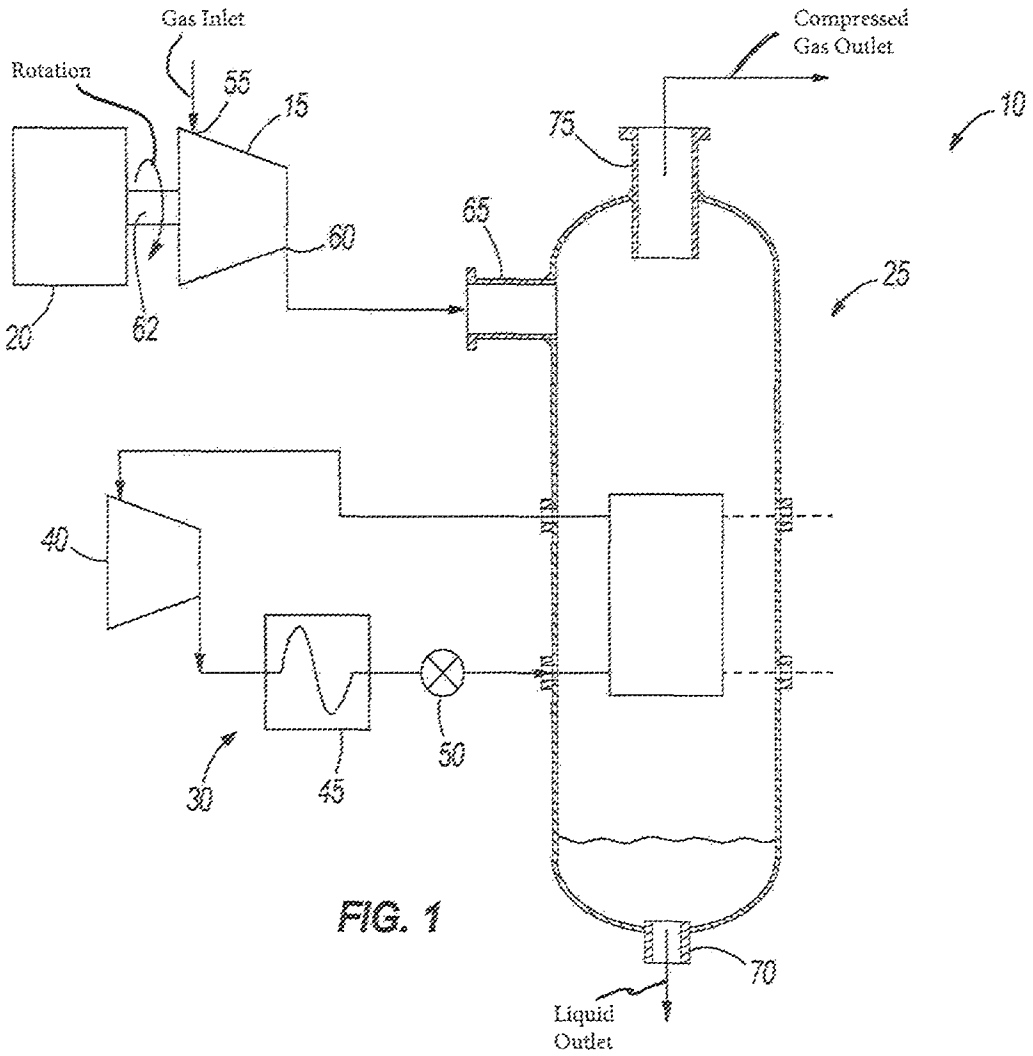
FIG. 1 is a perspective view of a compressor system including a heat exchanger.

FIG. 1 schematically illustrates a gas compression system 10 that includes a compressor 15, a prime mover 20, and a dryer 25. The compression system 10 includes a refrigeration system 30 and may optionally include a second fluid system. The refrigeration system 30 includes a refrigerant compressor 40, a condenser 45, and an expansion device 50 as is typical with refrigeration systems 30. The second fluid system, if included includes a pump and a reservoir for a second fluid that can be used as a heat sink to reduce the peak load on the refrigeration system 30.

The prime mover 20 can include an electric motor, an engine (e.g., internal combustion, rotary, turbine, diesel, etc.), or any other drive capable of providing shaft power to the compressor 15.

The compressor 15 includes an inlet 55 that provides a fluid flow path for incoming gas to be compressed and an outlet 60 through which compressed gas is discharged. The illustrated system is an open system for compressing air. Thus, air is drawn into the compressor 15 from the atmosphere and is compressed and discharged through the outlet 60. However, it should be understood that the compressor system 10 illustrated in FIG. 1 could be employed to compress many other gasses, and could be employed in a closed cycle (e.g., refrigeration system) if desired.

The compressor 15 includes a shaft 62 that is driven by the prime mover 20 to rotate a rotating element of the compressor 15. In some constructions, the compressor 15 includes a rotary screw compressor that may be oil flooded or oil less. In the oil flooded constructions, an oil separator would be employed to separate the oil from the compressed air before the air is directed to the dryer 25. In other constructions, a centrifugal or other compressor arrangement may be employed. Of course, single stage or multi-stage compressors could also be employed as may be required for the particular application.

The dryer 25 includes an air inlet 65 that receives compressed air from the compressor 15. In an open air compression system 10 as illustrated in FIG. 1, the compressed air includes moisture or water that is present in the air that is drawn into the compressor 15. During compression, the moisture is carried by the flow of compressed air as entrained liquid or a quantity of moisture. The dryer 25 includes a heat exchanger 80 and operates to separate a portion of the entrained liquid or quantity of moisture from the flow of compressed air, discharges the liquid from a drain 70 on the bottom of the dryer 25, and discharges the flow of substantially dry compressed air from an air outlet 75 at the top of the dryer 25.

The dryer 25 of FIG. 1 delivers a chilled refrigerant to the heat exchanger 80 which acts as the evaporator of the refrigeration system 30 to cool the air and moisture within the air to condense and remove a portion of the moisture. In one construction, the refrigerant flows through the heat exchanger 80 and the air flows over the heat exchanger 80 as will be described.

Figure 2:
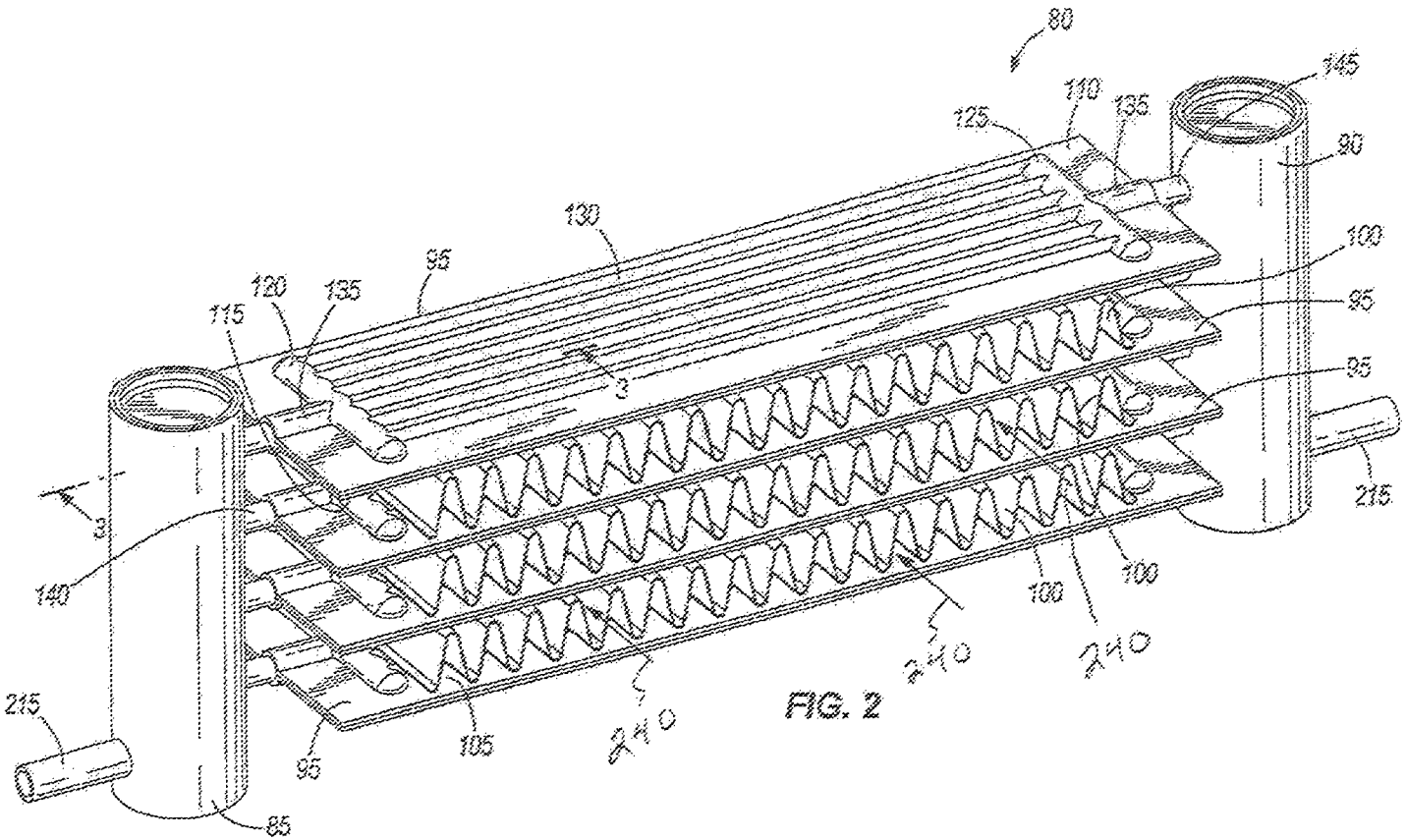
FIG. 2 is a perspective view of a portion of a formed microchannel heat exchanger suitable for use with the compressor of FIG. 1.

With reference to FIG. 2, one possible arrangement of the heat exchanger 80 is illustrated. The heat exchanger 80 includes an inlet header 85, an outlet header 90, a plurality of enclosed layers 95, and a plurality of corrugated members 100. Each corrugated member 100 includes a corrugated sheet of material that partially defines a plurality of flow channels 105. Each corrugated member 100 attaches to at least one adjacent enclosed layer 95 to more fully enclose the flow channels 105. In preferred constructions, the corrugated sheet of material is formed from a material well-suited to heat transfer applications such as metal and particularly aluminum, copper, stainless steel, and the like.

Each enclosed layer 95 includes an upper plate 110 and a lower plate 115 that are attached to one another. In preferred constructions, the upper plate 110 and the lower plate 115 are identical. Each plate 110, 115 is stamped or otherwise formed to partially define a formed inlet header 120, a formed outlet header 125, and a plurality of internal channels 130. The upper plate 110 and the lower plate 115 are then positioned in a facing relationship such that the formed portions 120, 125, 130 extend away from the opposite plate such that when the plates 110, 115 are attached to one another they cooperate to completely define and enclose the formed inlet header 120, the formed outlet header 125, and the plurality of internal channels 130. Each of the internal channels 130 extends substantially linearly from the formed inlet header 120 to the formed outlet header 125 and are substantially parallel to one another. In other constructions, the channels 130 may be curved and/or not parallel to one another. In addition, the channels 130 can be formed with smooth inner walls or could include bumps or other turbulence-inducing elements that enhance the heat transfer between the plates 110, 115 and the medium (refrigerant in the illustrated construction) flowing through the channels 130.

Each of the formed inlet header 120 and the formed outlet header 125 includes a tube portion 135 that extends from the respective header 120, 125 to the edge of the plates 110, 115. A first tube 140 is sized to fit within the tube portion 135 of the formed inlet header 110 and provides for fluid communication between the inlet header 85 and the formed inlet header 110. A second tube 145 is sized to fit within the tube portion 135 of the formed outlet header 125 and provides for fluid communication between the outlet header 90 and the formed outlet header 125.

Figure 3:
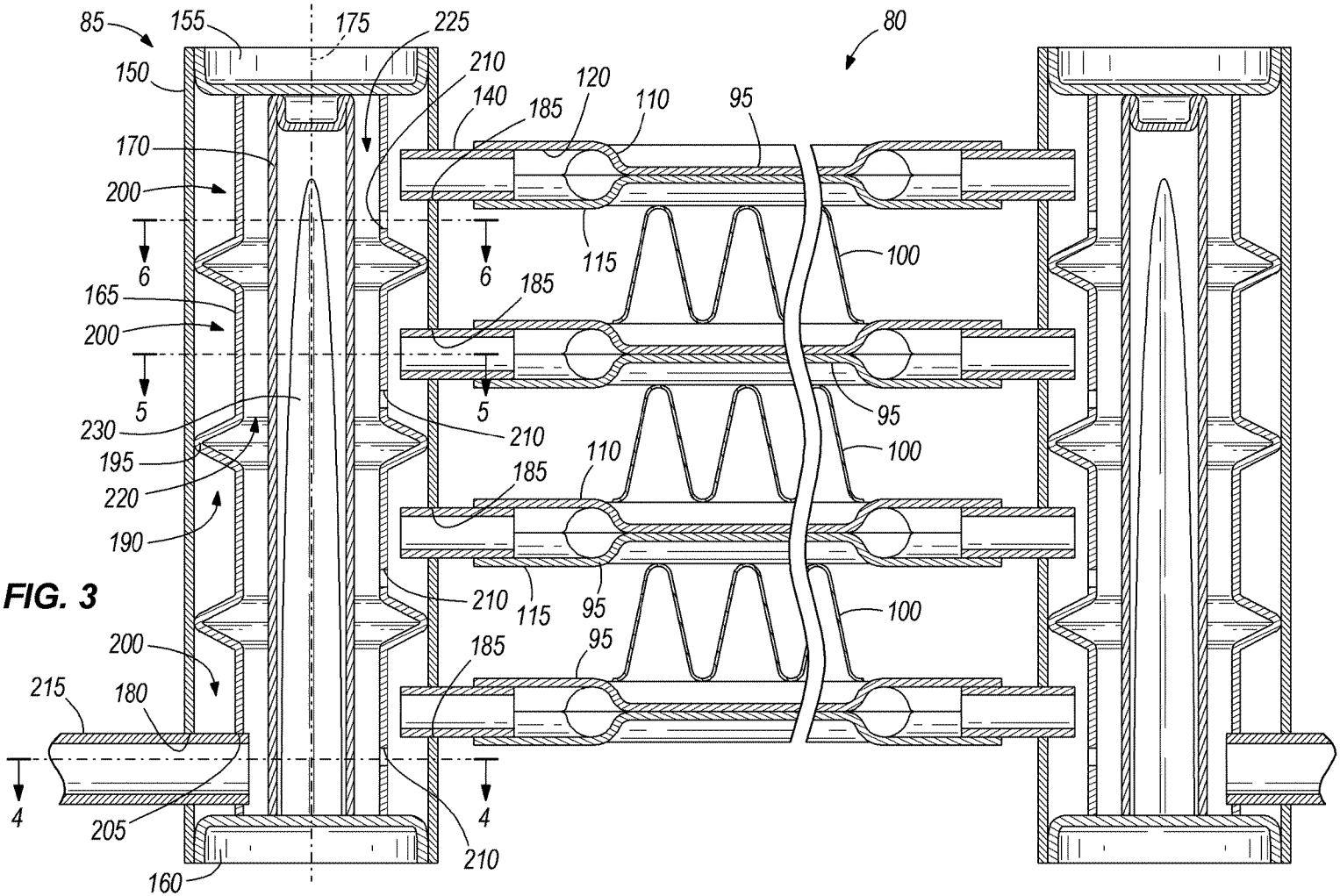
FIG. 3 is a section view of the heat exchanger of FIG. 2, taken along line 3-3 of FIG. 2.

As illustrated in FIG. 3, the inlet header 85 includes an outer wall 150, a first cap 155, a second cap 160, a ribbed wall 165, and a filler plug 170. The outer wall 150 includes a substantially cylindrical tube that is open at the top and bottom and that defines a longitudinal or central axis 175. The outer wall 150 includes an inlet aperture 180 and a plurality of outlet apertures 185 that each receives one of the first tubes 140. The first cup 155 sealingly attaches to the outer wall 150 near one end and the second cap 160 sealingly attaches to the outer wall 150 near the second opposite end to fully enclose an interior 190 of the outer wall 150.

The ribbed wall 165 is disposed within the interior 190 of the outer wall 150 and extends from the first cup 155 to the second cup 160 Annular ribs 195 extend around the circumference of the ribbed wall 165 and sealingly contact the outer wall 150. The annular ribs 195, the ribbed wall 165, and the outer wall 150 cooperate to define a number of annular spaces 200. In preferred constructions, the number of annular spaces 200 is equal to the number of enclosed layers 95 such that one of the first tubes 140 extends through one of the outlet apertures 185 of the outer wall 150 to provide fluid communication between the annular space 200 and the first tube 140. Of course, other constructions may be arranged with more or fewer annular spaces 200 than enclosed layers 95.

The ribbed wall 165 includes an inlet aperture 205 near one end and a plurality of outlet apertures 210 with each outlet aperture 210 disposed adjacent one of the annular spaces 200. An inlet tube 215 extends from a source of fluid (downstream of the expansion device 50), through the inlet aperture 180 of the outer wall 150 and through the inlet aperture 205 of the ribbed wall 165 to provide for a flow of fluid into a space 220 within the ribbed wall 165.

Figure 4:
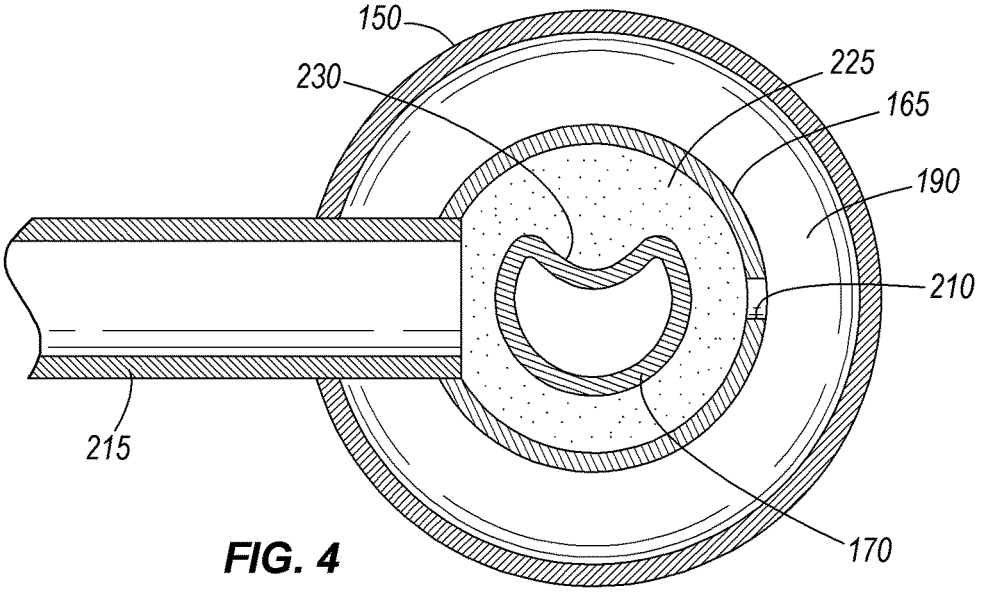
FIG. 4 is a section view of a header of the heat exchanger of FIG. 3 taken along line 4-4 of FIG. 3.
Figure 5:
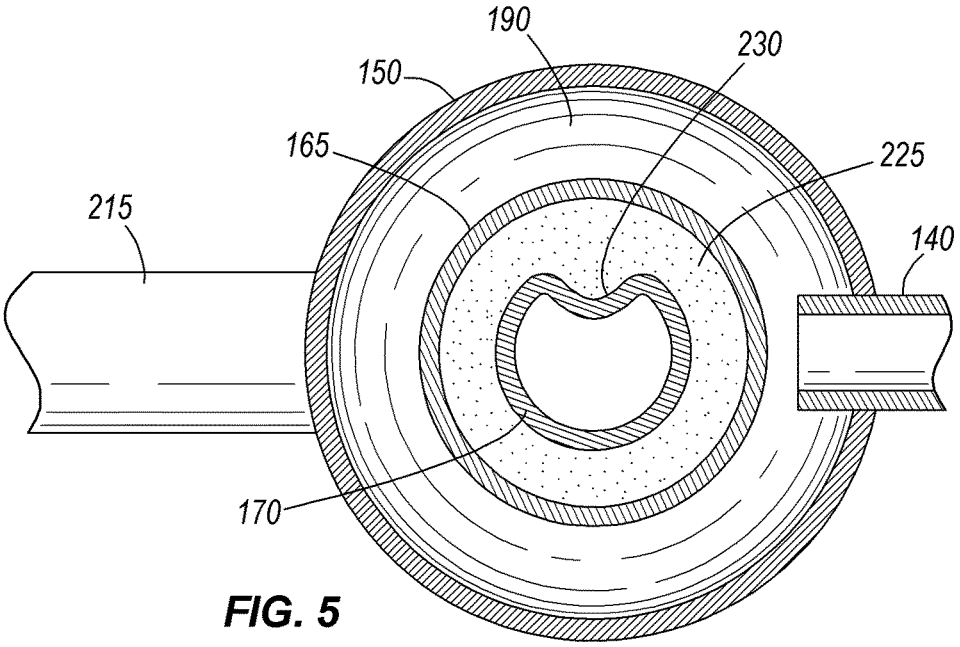
FIG. 5 is a section view of a header of the heat exchanger of FIG. 3 taken along line 5-5 of FIG. 3.
Figure 6:
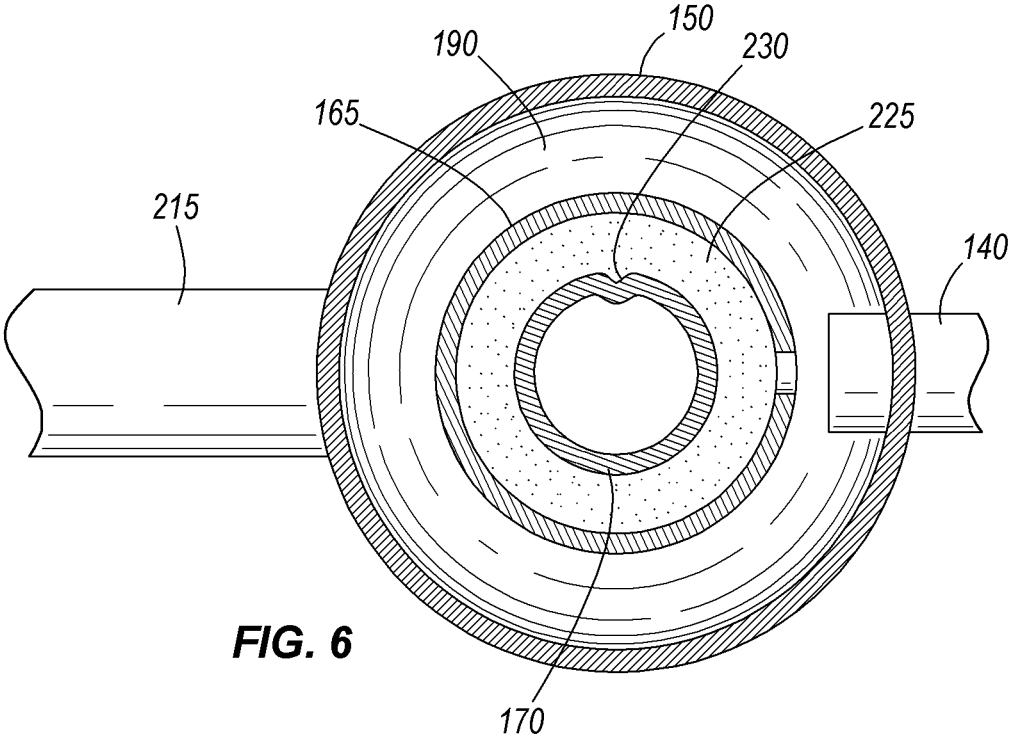
FIG. 6 is a section view of a header of the heat exchanger of FIG. 3 taken along line 6-6 of FIG. 3.

The filler plug 170 is disposed in the space 220 within the ribbed wall 165 and extends from the first cap 155 to the second cap 160. The filler plug 170 cooperates with the ribbed wall 115 to define an annular flow area 225 that extends between the first cap 155 and the second cap 160. The filler plug 170 is substantially cylindrical and includes a tapered portion 230 arranged such that the flow area as measured normal to the central axis 175 of the filler plug 170 is non-uniform. The area decreases as the distance from the inlet 205 increases. FIGS. 4-6 illustrate this decrease in area as the distance from the inlet 205 increases.

Before proceeding, it should be noted that the inlet header 85 and the outlet header 90 can be substantially the same. As such, the outlet header 90 will not be described in detail other than to note that any features described with regard to the inlet header 85 as an "inlet" would be an "outlet" with regard to the outlet header 90 and visa versa. In preferred constructions, the inlet header 85 and outlet header 90 are not identical. Typically, the inlet header 85, particularly when the heat exchanger is an evaporator, uses the illustrated construction to carefully control the equal distribution of the evaporating liquid gas mixture to the various enclosed layers 95. Generally, the outlet header 90 can be a simple tube. For condensers, both the inlet header 85 and the outlet header 90 can be plain tubes if desired.

To assemble the heat exchanger 80 of FIGS. 1-7, the headers 85, 90 first formed. The headers 85, 90 can be stacked or arranged as illustrated in FIG. 3 and then brazed in a single brazing operation. Alternatively, the components can be attached to one another and brazed, soldered, welded, or the like in a step-by-step fashion.

In one arrangement, the filler plug 170 and the ribbed wall 165 are sealingly attached to each of the first cap 155 and the second cap 160 to enclose the space 220. The filler plug 170, ribbed wall 165, first cap 155, and second cap 160 are then inserted into the outer wall 150 and sealingly attached to the outer wall 150 to enclose the annular spaces 200. Finally, the inlet tube 215 (outlet tube for the outlet header 90) and the first tubes 140 (second tubes 145 for the outlet header 90) are inserted through the outer wall 150, with the inlet tube 215 also passing through the ribbed wall 165. The tubes 140 are then sealingly attached to the components through which they pass to complete the assembly.

In a preferred arrangement, the components of the headers 85, 90 are clad with a low melting point material and are positioned as illustrated in FIG. 3. The entire assembly is then heated to a desired temperature to melt the low melting point material and sealingly attach all of the components to the components that they contact.

Figure 7:
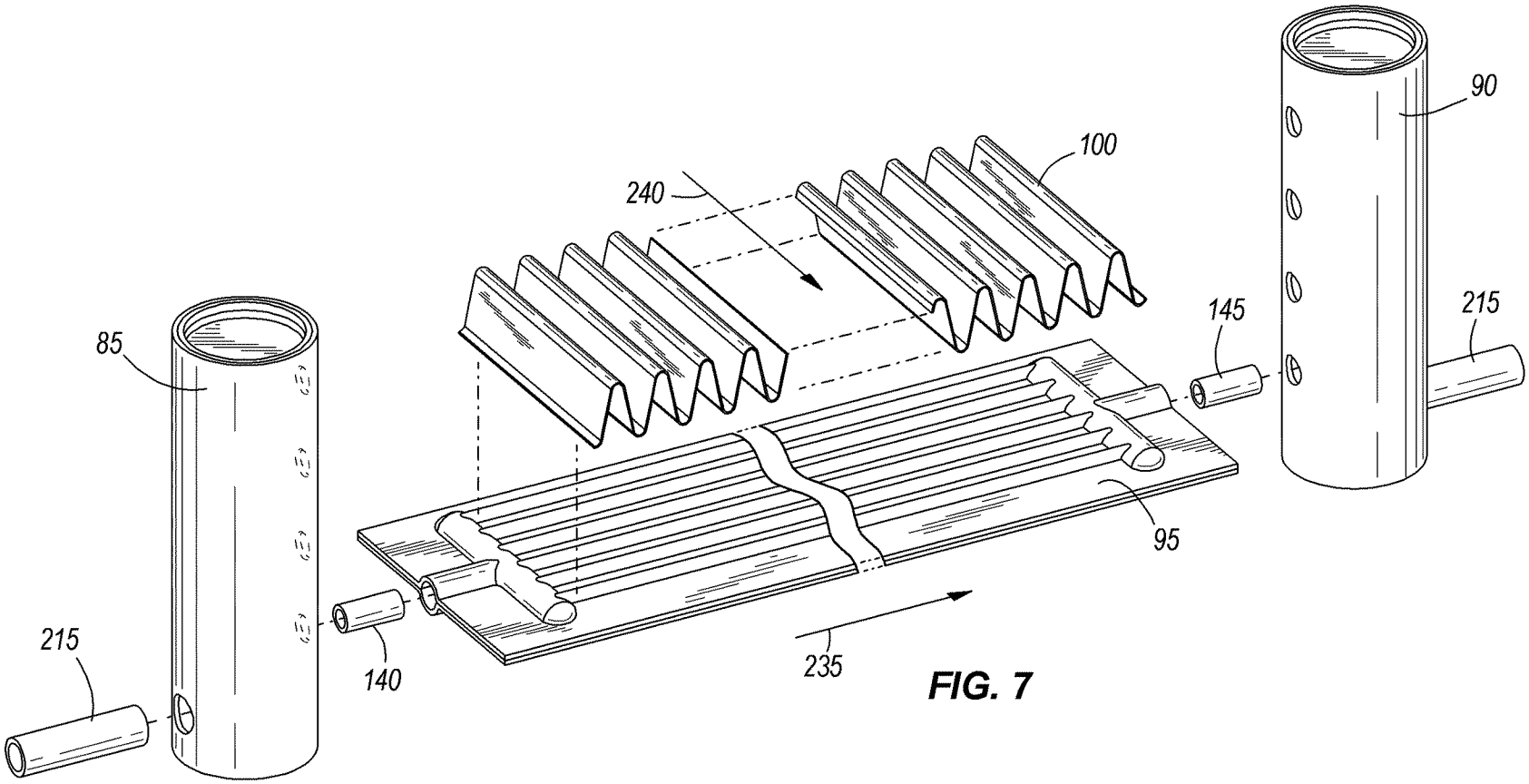
FIG. 7 is an exploded perspective view of a portion of the heat exchanger of FIG. 2 illustrating a formed microchannel plate.

FIG. 7 illustrates a partially exploded view of the heat exchanger 80 to illustrate the assembly process. In some constructions, each of the components is clad with a low melting point material to allow brazing of the entire assembly in one brazing operation. The upper plate 110 and lower plate 115 of each enclosed layer 95 are thus positioned adjacent one another in the desired facing relationship. The first tube 140 and second tube 145 are inserted between the upper plate 110 and lower plate 115 and are inserted into the respective inlet/outlet apertures 180 of the inlet header 85 and the outlet header 90. Corrugated members 100 are positioned between the enclosed layers 95 and, if desired on the top and/or bottom of the uppermost and lowermost enclosed layer 95. The entire assembly is then heated to a desired temperature to melt the low melting point material and sealably attach all of the components to make a single unitary structure. In other constructions, the components are assembled in multiple steps. For example, in one construction, the upper plate 110 and lower plate 115 of the various enclosed layers 95 are first attached to one another. Next, the first tube 140 and the second tube 145 are attached to each of the enclose layers 95 and corrugated members 100 are attached to the enclosed layers 95 as required. Finally, the first tube 140 and the second tube 145 of each enclosed layer 95 are attached to the respective inlet header 85 and outlet header 90 to complete the assembly.

In operation, a flow of fluid passes from a source such as from the discharge of the expansion device 50 of the refrigeration system 30 into the inlet header 85 via the inlet tube 215. With reference to FIG. 3, the flow is directed to the inner space 220 defined by the cooperation of the filler plug 170 and the ribbed wall 165. As the flow passes from the first end of the inner space 220 toward the second end, portions are discharged from the inner space 220 to the annular spaces 200 via the outlet apertures 185. The flow velocity within the header 85 is a function of the mass flow and the area, as the density of the fluid remains substantially constant. As flow is discharged, the flow velocity would decrease if the flow area of the inner space 220 were uniform. However, as illustrated in FIGS. 3-6, the flow area of the inner space 220 actually decreases as the mass flow decreases, thereby producing a substantially uniform flow rate within the inlet header 85. The uniform flow rate within the header 85 improves the distribution of fluid to the various enclosed layers 95 to assure relatively uniform flow to each enclosed layer 95.

The flow discharged from the outlet apertures 185 collects in the annular spaces 200 between the ribs 195 and is directed into the desired enclosed layers 95. With reference to FIG. 2, the flow passes through the tube portion 135 of the formed inlet header 120 and is then distributed to the various internal channels 130. The flow then flows in a generally first direction 235 to the formed outlet header 125 and the tube portion 135 of the formed outlet header 125. As noted above, in some constructions, the internal channels may zig zag or move in another non-linear direction if desired. However, ultimately, the fluid moves from one end of the enclosed layer 95 to an opposite end and as such moves in the generally first direction 235.

With reference to FIG. 3, the flow then enters the annular spaces 200 of the outlet header 90 and is collected in the various annular spaces 200 between the ribs 195 of the ribbed wall 165. The flow passes from the annular spaces 200 to the inner space 220 via the inlet apertures 185 formed in the ribbed wall 165. As the flow enters the inner space 220 and flows toward the outlet tube 215, the quantity of fluid increases. To maintain the flow velocity, the flow area of the inner space 220 increases in the flow direction. As discussed, the increased space is a result of the increase in the size of the tapered portion 230 of the filler plug 170. The flow then exits the outlet header 90 via the outlet tube 215 and, as illustrated in FIG. 1 returns to the refrigerant compressor 40 to complete the refrigeration cycle. Thus, the heat exchanger 80 of FIG. 1 operates as an evaporator to cool the air flow to condense water from the air flow to produce the desired flow of dry air.

A second fluid that is being heated or cooled by the fluid in the enclosed spaces 95 is directed through the channels 105 defined by the corrugated members 100. The flow generally flows in a second direction 240 that is normal to the first direction 235. However, zig zags or other non-linear flow paths could be defined by the corrugated members 100. In addition, the corrugated members 100 could be arranged to produce a diagonal flow or even a flow that is substantially parallel to the flow in the enclosed layers 95 if desired.

Figure 8:
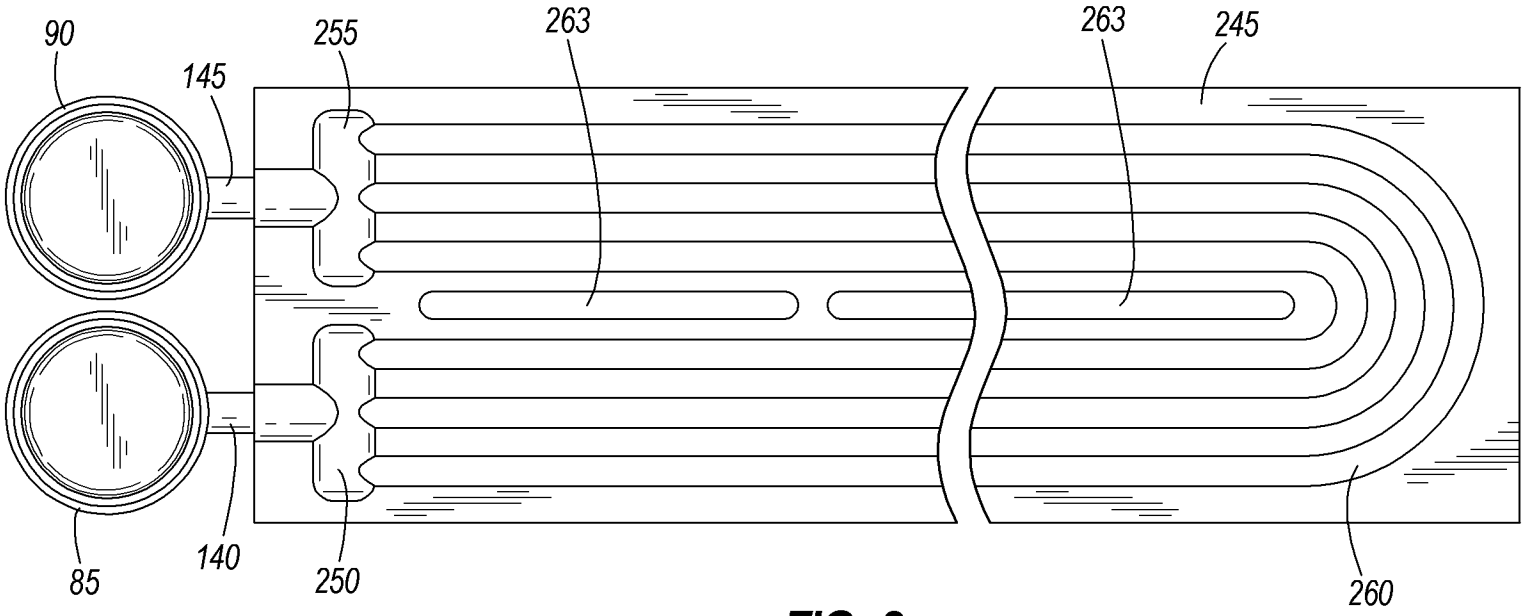
FIG. 8 is a top view of another formed microchannel plate suitable for use with the heat exchanger of FIG. 2.

FIG. 8 illustrates another arrangement of an enclosed layer 245 suitable for use with the heat exchanger 80 of FIGS. 1-7. The enclosed layer 245 of FIG. 8 is formed and assembled in much the same manner as was described with regard to FIGS. 1-7. The construction of FIG. 8 includes an enclosed inlet header 250 and an enclosed outlet header 255 as with the construction of FIGS. 1-7. However, rather than being disposed on opposite ends of the enclosed layer 245, the enclosed inlet header 250 and the enclosed outlet header 255 are disposed on the same side of the enclosed layer 245. Thus, the enclosed channels 260 that extend from the enclosed inlet header 250 to the enclosed outlet header 255 are U-shaped. The flow within the enclosed channels 260 flows in a first direction 235, much as with the construction of FIGS. 1-7, turns at one end of the enclosed layer 245 and then returns in a direction opposite the first direction 235. A thermal break 263 is positioned between the channels 260 that are directing fluid in opposite directions to inhibit heat transfer between the channels 260. In constructions employing the enclosed layer 245 of FIG. 8, the inlet header 250 and the outlet header 255 would be positioned adjacent the same end of the enclosed layer 245 rather than on opposite ends as illustrated in FIG. 2.

Figure 9:
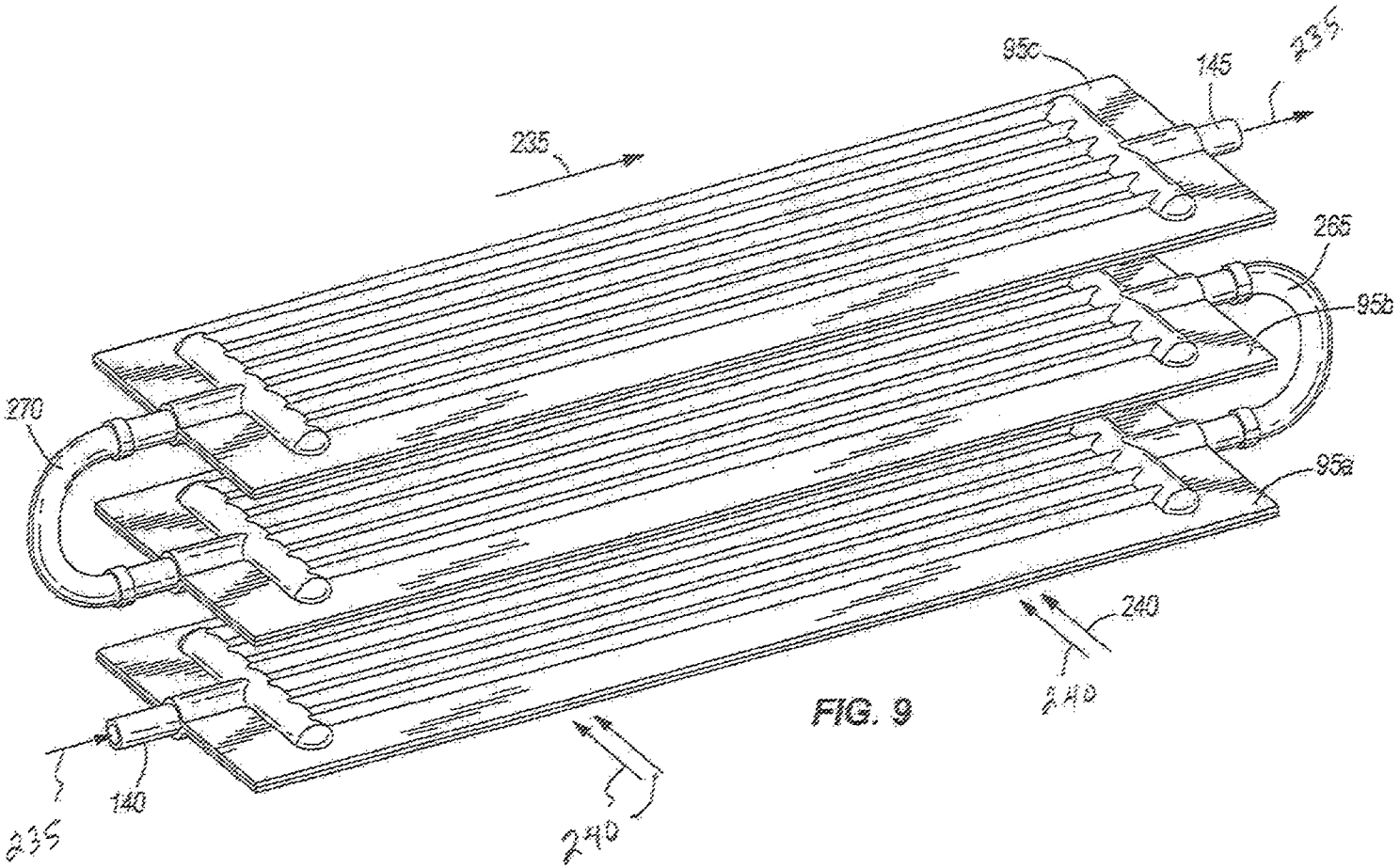
FIG. 9 is a perspective view of another heat exchanger including several formed microchannel plates similar to those of FIG. 7 connected in series.

FIG. 9 illustrates another arrangement of the enclosed layers 95 of FIGS. 1-7. The enclosed layers 95 and the remainder of the complete heat exchanger 80 are substantially the same as the enclosed layers 95 and the remainder of the heat exchanger 80 illustrated in FIGS. 1-7. However, rather than connecting one end of each enclosed layer 95 to the inlet header 85 and the other end to the outlet header 90, the enclosed layers 95 are arranged to direct the flow through three enclosed layers 95 before discharging the fluid. The flow passes in a first direction 235 through a first enclosed layer 95*a*, through a flow device 265 (e.g., tube, pipe, conduit, etc.) to a second enclosed layer 95*b* and flows in a second direction substantially opposite the first direction 235. The flow then passes through a second flow device 270 to a third enclosed layer 95*c* that directs the fluid in the first direction 235. After passing through the third enclosed layer 95*c*, the fluid is discharged from the heat exchanger 80.

In yet another arrangement similar to the one of FIG. 9, the flow passes through only the first two enclosed layers 95 and is discharged. In this arrangement, the inlet header 85 and the outlet header 90 are both positioned on the same side of the enclosed layers 95, rather than on opposite sides as in the arrangement of FIG. 9.

Figure 10:
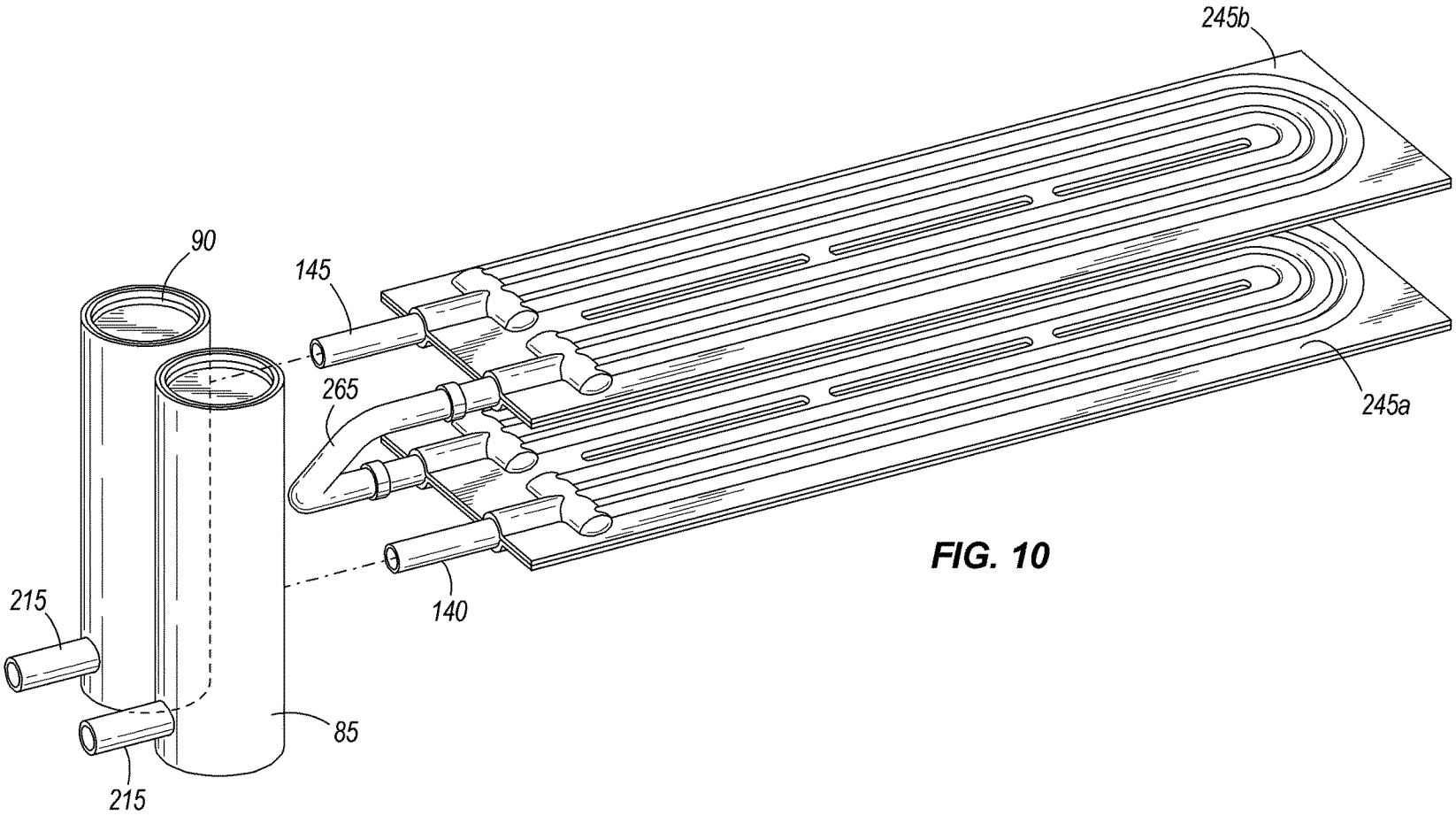
FIG. 10 is a perspective view of another heat exchanger including several formed microchannel plates similar to those of FIG. 8 connected in series.

In still another arrangement illustrated in FIG. 10, the enclosed layers 245 of FIG. 8 are arranged such that the flow passes through a first enclosed layer 245*a* and a second enclosed layer 245*b* before the flow is discharged. Thus, the construction of FIGS. 1-7 produces a heat exchanger 80 in which the flow in the enclosed layers 95 flows across the corrugated members 100 once and is discharged. The construction of FIG. 8 provides an arrangement in which the flow crosses the corrugated members 100 twice before it is discharged. The construction of FIG. 9 provides three crossings of the corrugated members 100 while the construction of FIG. 10 provides four. As one of ordinary skill will realize, there are other arrangements of the various constructions illustrated herein that can achieve different degrees of heat exchange. For example, the enclosed layer 245 of FIG. 8 could be combined with the enclosed layers 95 of FIGS. 1-7 to achieve three crossings using only two enclosed layers 95, 245. Thus, the invention should not be limited to the constructions illustrated and discussed herein.

Thus, the invention provides, among other things, a heat exchanger 80 that includes a plurality of formed channels 130 that is easily constructed. Various features and advantages of the invention are set forth in the following claims.

What is claimed is:

1. A heat exchanger comprising:

a plurality of heat exchange layers stacked in a stackwise direction, each of the heat exchange layers include a first plate and a second plate extending between longitudinally opposing first and second ends, each of the first plate and the second plate including a portion of a first enclosed header located proximate the first end, a second enclosed header located proximate the second end and a plurality of flow channels that extends between the first enclosed header and the second enclosed header, wherein the first plate and the second plate are fixedly attached to one another to completely define the first enclosed header, the second enclosed header, and the plurality of flow channels;

an inlet header located adjacent the first end connected with the first enclosed header of each of the plurality of heat exchange layers such that a flow of fluid is directed to each of the heat exchange layers in parallel from the inlet header;

an outlet header located adjacent the second end connected with the second enclosed header of each of the plurality of heat exchange layers such that the flow of fluid is directed from each of the heat exchange layers in parallel to the outlet header; and a plurality of fins, each positioned between adjacent heat exchange layers.

2. The heat exchanger of claim 1, wherein the portion of the first enclosed header, the second enclosed header and the flow channels are formed from indentations formed in each of the first plate and the second plate.

3. The heat exchanger of claim 1, wherein the flow channels direct fluid in a first direction and the plurality of fins direct a second fluid in a second direction that is substantially normal to the first direction.

4. The heat exchanger of claim 1, wherein the inlet header includes an outer wall, an inner wall, and a filler plug that defines a longitudinal axis, and wherein the inner wall and the filler plug cooperate to define an inner space that receives the flow of fluid from a source, and the inner wall and the outer wall cooperate to define an outer space that directs the flow of fluid to each of the heat exchange layers.

5. The heat exchanger of claim 4, wherein the inner wall includes portions protruding outward to define a plurality of annular ribs that sealingly contact the outer wall to divide the outer space into a plurality of separate annular spaces.

6. The heat exchanger of claim 5, wherein the number of annular spaces is equal to the number of heat exchange layers.

7. The heat exchanger of claim 4, wherein the filler plug includes a portion having a non-circular cross-section taken normal to the longitudinal axis, the cross-section varying along the length of the longitudinal axis.

8. The heat exchanger of claim 1, wherein the first plate is substantially the same as the second plate.

* * * * *